US007270074B2

(12) United States Patent
Pradetto et al.

(10) Patent No.: US 7,270,074 B2
(45) Date of Patent: Sep. 18, 2007

(54) DIVER PROPULSION SYSTEM WITH SEPARATE BATTERY AND MOTOR-TRANSMISSION MODULES

(76) Inventors: James T. Pradetto, 2742 Burbank St., Dallas, TX (US) 75235; Dean A. Vitale, 19700 Franjo Rd., Miami, FL (US) 33157

( * ) Notice: Subject to any disclaimer, the term of this patent is extended or adjusted under 35 U.S.C. 154(b) by 0 days.

(21) Appl. No.: 11/119,527

(22) Filed: Apr. 29, 2005

(65) Prior Publication Data

US 2006/0243188 A1 Nov. 2, 2006

(51) Int. Cl.
*B63C 11/46* (2006.01)

(52) U.S. Cl. ..... 114/315; 440/6

(58) Field of Classification Search ..... 114/315; 440/6

See application file for complete search history.

(56) References Cited

U.S. PATENT DOCUMENTS

| | | | | |
|---|---|---|---|---|
| 3,034,467 | A * | 5/1962 | Pestronk | 440/6 |
| 3,916,814 | A * | 11/1975 | Bardoni et al. | 114/315 |
| 3,995,578 | A * | 12/1976 | McCullough | 440/6 |
| 4,305,012 | A * | 12/1981 | Friedel | 310/87 |
| 4,864,959 | A * | 9/1989 | Takamizawa et al. | 114/315 |
| 2004/0094083 | A1 * | 5/2004 | Mazin | 114/315 |

* cited by examiner

*Primary Examiner*—Sherman Basinger
(74) *Attorney, Agent, or Firm*—Tod R. Nissle, P.C.

(57) ABSTRACT

A diver propulsion system includes separate battery and motor-transmission modules.

7 Claims, 3 Drawing Sheets

FIG. 1
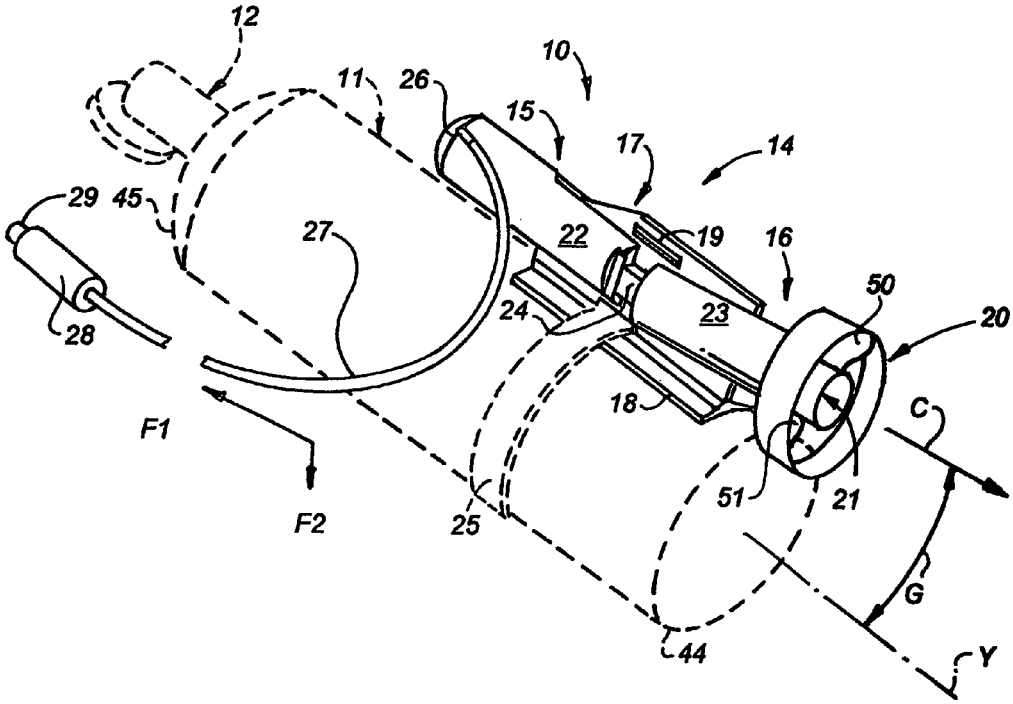
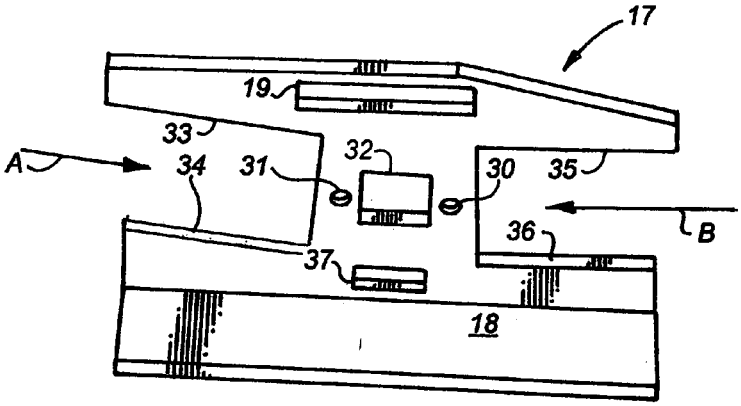
FIG. 2

FIG. 3
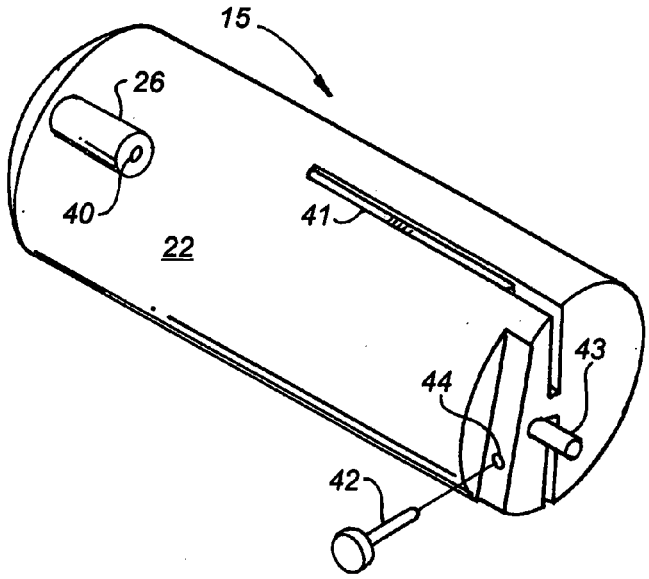
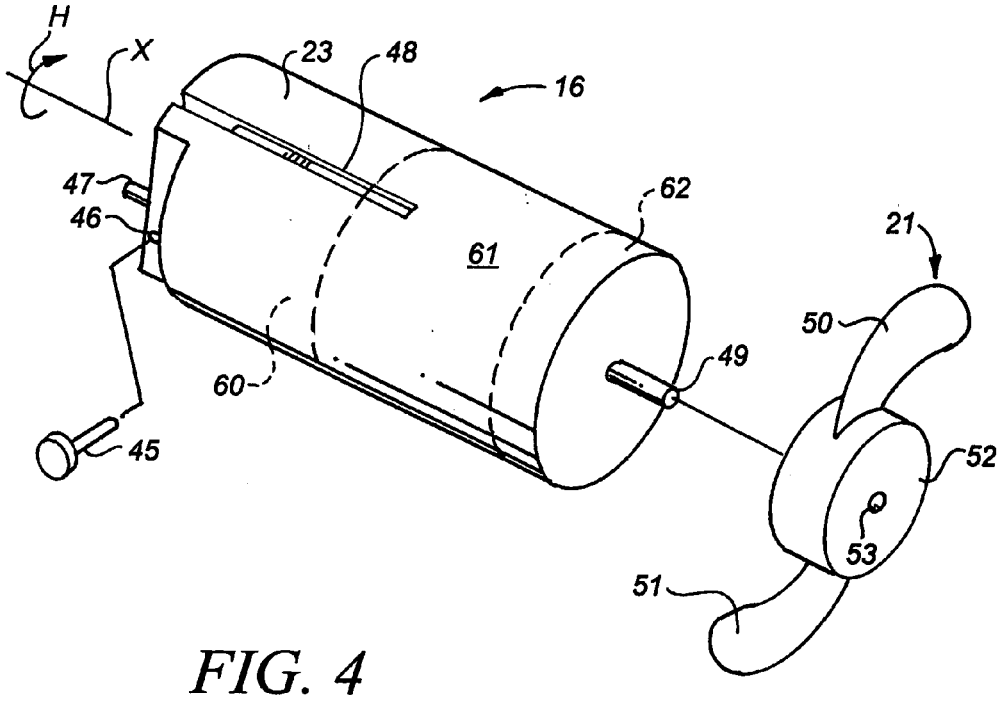
FIG. 4

DIVER PROPULSION SYSTEM WITH SEPARATE BATTERY AND MOTOR-TRANSMISSION MODULES

This invention pertains to diving equipment.

More particularly, the invention pertains to a propulsion system for scuba divers.

Providing supplemental propulsion for divers, in particular scuba divers, is desirable for a variety of reasons. For example, supplemental propulsion enables a scuba diver to direct to other tasks energy that normally would be expended in swimming or maneuvering through water. One kind of well known propulsion unit is a "scooter" that is positioned in front of a scuba diver. The scooter includes handles at the rear of the scooter. A diver grasps the handles and the scooter pulls the diver through the water. While scooters are useful, the size of a scooter limits the mobility in the water of a diver and makes transport and storage of the scooter cumbersome. Scooters allow no "hands-free" operations, if necessary.

Accordingly, it would be highly desirable to provide an improved supplemental propulsion system for a scuba diver that would (1) enhance mobility, (2) decrease oxygen consumption, (3) allow "hands-free" operation, and (4) be compact and lightweight in storage use.

Therefore, it is a principal object of the instant invention to provide an improved underwater propulsion system.

A further object of the invention is to provide an improved propulsion system that can be readily assembled, installed, and utilized by a scuba diver.

Another object of the invention is to provide an improved propulsion system that provides a high thrust to weight ratio.

These and other, further and more specific objects and advantages of the invention will be apparent to those skilled in the art from the following detailed description thereof, taken in conjunction with the drawings, in which:

FIG. 1 is a perspective view illustrating a propulsion system constructed in accordance with the principles of the invention;

FIG. 2 is a perspective view illustrating a bracket utilized to hold the motor-transmission and battery housings of the propulsion system of FIG. 1;

FIG. 3 is a perspective view illustrating a battery module utilized in the propulsion system of FIG. 1;

FIG. 4 is a perspective view illustrating a motor-transmission module utilized in the propulsion system of FIG. 1; and, FIG. 5 is a section view of the propeller shroud in the propulsion system of FIG. 1.

Figure 5:
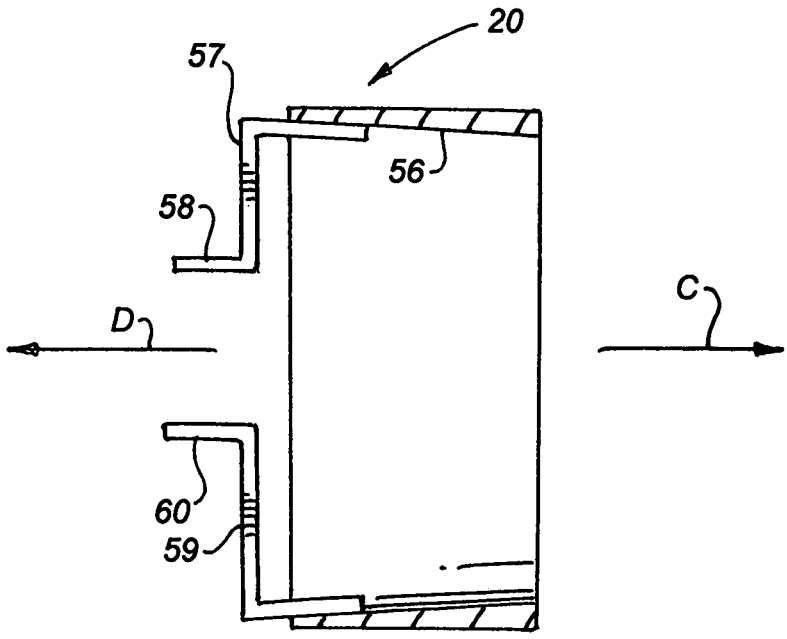

Briefly, in accordance with the invention, we provide an improved scuba diving propulsion system. The system comprises a tank of breathable gas; a regulator attached to the tank to supply breathable gas to a diver; and, a propulsion apparatus. The propulsion apparatus comprises a housing; apparatus securing the propulsion apparatus to the tank; a battery mounted on the housing; and, a motive power module mounted on the housing. The motive power module includes an electric motor; a transmission operatively associated with the motor to increase torque; a propeller shaft operatively associated with the transmission; and, a propeller mounted on the propeller shaft.

In another embodiment of the invention, we provide an improved propulsion unit for scuba diving breathing equipment. The breathing equipment includes a tank of breathable gas and a regulator attached to the tank to supply breathable gas to a diver. The propulsion unit includes a housing; apparatus to secure the propulsion system to the tank; a battery module detachably mounted on the housing; and, a motive power module detachably mounted on the housing and spaced apart from the battery module. The power module includes an electric motor; a transmission operatively associated with the motor; a propeller shaft operatively associated with the transmission; and, a propeller mounted on the propeller shaft.

In a further embodiment of the invention, we provide an improved propulsion unit for scuba diving breathing equipment. The breathing equipment includes a tank of breathable gas and a regulator attached to the tank to supply breathable gas to a diver. The improved propulsion unit includes a housing; apparatus to secure the propulsion system to the tank; an electrical connector mounted on the housing; a battery module mounted on the housing and electrically attached to the electrical connector; and, a motive power module mounted on the housing and spaced apart from said battery module. The motive power module includes an electric motor, a transmission operatively associated with the motor, a propeller shaft operatively associated with the transmission, and, a propeller mounted on the propeller shaft. The power module is electrically attached to the electrical connector such that electricity flows from the battery module through the electrical connector to the power module.

In still another embodiment of the invention, we provide an improved scuba diving propulsion system. The system comprises a tank of gas having a first end and a second end and charged with breathable gas; a regulator attached to the tank to supply the breathable gas to a diver; and, a propulsion apparatus having a selected weight. The propulsion apparatus comprises a housing; apparatus securing the propulsion apparatus to the tank; a battery mounted on the housing; and, a motive power module mounted on the housing and including a propeller. The housing includes a foot shaped and dimensioned to conform to the tank, to contact the tank intermediate the first and second ends, and to distribute the weight over a selected area on the tank.

Turning now to the drawings, which depict the presently preferred embodiments of the invention for the purpose of illustrating the practice thereof and not by way of limitation of the scope of the invention and in which like reference characters refer to corresponding elements throughout the several views, FIGS. 1 to 5 illustrate a scuba diver propulsion system constructed in accordance with the invention and generally indicated by reference character 10. The propulsion system 10 includes a tank 11 charged with breathable nitrogen, oxygen, air or other generally non-toxic breathable gases. Tank 11 includes a distal end 44 and a proximate end 45. A regulator 12 is connected to proximate end 45 in conventional fashion to provide to a diver at a desired flow rate breathable gas from tank 11. The regulator is attached to a hose and mouthpiece (not shown) in conventional fashion. The construction of regulators 12 and tanks 11 is well known and is not discussed in detail herein.

The propulsion system 10 also includes a propulsion unit 14. Unit 14 includes bracket 17. Battery module 15 and motor-transmission-propeller shaft module 16 are slidably detachably mounted on bracket 17 in the manner discussed below. Strap 25 extends through opening 37 in bracket 17 and secures bracket 17 in position on tank 11. At least one end of strap 25 preferably includes a buckle to facilitate the attachment and removal of strap 25 from tank 11. Foot 18 of bracket 17 is shaped to conform to the outer surface of tank 11 at a location generally intermediate ends 44 and 45. Positioning foot 18 intermediate ends 44 and 45 facilitates the even distribution of the weight of unit 14 over the length of tank 11, and facilitates balancing the weight of unit 14 on the back of a diver such that the weight of unit 14 is not substantially concentrated at either end 44, 45 of tank 11.

Rectangular opening 32 of bracket 17 (FIG. 2) is shaped to receive electrical connector 24 (FIG. 1). Connector 24 includes a pair of openings (not visible) that each slidably receive one of connector pins 43 (on battery module 15) and 47 (on motor-transmission module 16). Connector 24 permits electricity to flow from battery module 15, through pin 43, through connector 24, and through pin 47 to motor-transmission module 16. Rectangular opening 19 in bracket 17 functions as a handle.

The U-shaped opening on the left of bracket 17 in FIG. 2 includes parallel edges or tracks 33, 34 each shaped and dimensioned to slidably engage one of an opposing pair of parallel slots 48 formed in the cylindrical shaped surface 23 of module 16 such that module 16 can be slidably inserted in bracket 17 in the direction of arrow A (FIG. 2) to the position illustrated in FIG. 1. In FIG. 4 one slot 48 is visible while the other is on the bottom of module 16 in FIG. 4 and is not visible. Each slot 48 has an equivalent shape and dimension. When module 16 is slidably inserted in bracket 17 to the position shown in FIG. 1, aperture 46 in module 16 is aligned with aperture 31 in bracket 17 and quick release pin 45 is inserted through aperture 46 into aperture 31 to secure module 16 in position on bracket 17. Any desired fastening system can be utilized to secure module 16 on bracket 17. In FIG. 1, module 16 is rotated 180 degrees about axis X from the orientation shown in FIG. 4.

The U-shaped opening on the right of bracket 17 in FIG. 2 includes parallel edges or tracks 35, 36 each shaped and dimensioned to slidably engage one of an opposing pair of parallel slots 41 formed in the cylindrical shaped surface 22 of module 15 such that module 15 can be slidably inserted in bracket 17 in the direction of arrow B (FIG. 2) to the position illustrated in FIG. 1. In FIG. 3, one of slots 41 is visible while the other slot is located on the bottom of module 15 in FIG. 3 and is not visible. Each slot 41 has an equivalent shape and dimension. When module 15 is slidably inserted in bracket 17 to the position shown in FIG. 1, aperture 44 in module 16 is aligned with aperture 30 in bracket 17 and quick release pin 42 is inserted through aperture 44 into aperture 31 to secure module 16 in position on bracket 17. Any desired fastening system can be utilized to secure module 16 on bracket 17.

Battery module 15 includes connector 26 with cylindrical socket or opening 40. Opening 40 is shaped to receive slidably an electrical connector pin (not shown) at the distal end of control cable 27. The proximate end of cable 27 includes a handle 28 and a control button 29. A diver depresses and releases button 29 to activate a switch that permits electricity to flow from module 15, through pin 43, through connector 24, and through pin 49 to electric motor 60 in module 16. When a diver again depresses and releases button 29, the switch is closed or otherwise deactivated and electricity does not flow from module 15 to module 16. Any desired mechanism can be selected and used to activate and deactivate the flow of electricity from module 15 to module 16.

When electricity flows from module 15 to module 16, motor 60 operates. Transmission 61 is connected to and operatively associated with motor 60. Transmission 61 functions to increase the torque produced by motor 60. Transmission 61 can be constructed in any desired fashion, but typically includes a system of interconnected gears. Propeller shaft 49 is connected to and turned by transmission 61. Consequently, when motor 60 is running, shaft 49 is rotated and the propeller 21 mounted on shaft 49 rotates simultaneously with shaft 29.

Propeller 21 includes hub 52 and typically also includes at least a pair of blades 50, 51 connected to and outwardly extending from hub 52. The shape and dimension of blades 50 and 51 can be altered as desired to facilitate the accomplishment of any desired function of blades 50 and 51. Rotation of blades 50 and 51 displaces water in the direction of arrow C in FIG. 1 to produce a force F1 acting in a direction opposite that of arrow C to propel a diver wearing tank 11 in a direction opposite that of arrow C. The longitudinal axis or centerline Y of cylindrical tank 11 is shown in FIG. 1. The direction indicated by arrow C in FIG. 1 is coincident with the longitudinal axis or centerline of cylindrical housing 23. Axis Y is not parallel to arrow C. Instead, there preferably is a small angle G in the range of one degree to thirty degrees, preferably five degrees to twenty degrees, most preferably ten to fifteen degrees, between axis Y and arrow C. This angle or cant of module 16 and the axis of rotation of shaft 49 causes F1 to act in a direction that is not parallel to the back of a diver wearing tank 11, but that is instead at an angle to and "pointing into" the back of the diver. Such cant of module 16 produces a force F2 that tends to press downwardly against the back of the diver and to prevent the diver from rising upwardly in the water.

As is illustrated in FIG. 5, the inner surface 56 of propeller shroud 20 is conically shaped such that water drawn through shroud 20 in the direction of arrow C accelerates in a venturi like fashion to facilitate the propulsion of a diver in the direction of arrow D. Legs 57 and 59 are attached to the inner surface 56 of shroud 20. Feet 58, 60 of legs 57 and 58, respectively, are attached to cylindrical surface 23 of module 16.

In use, strap 25 is utilized to secure removably propulsion unit 14 to a tank 11. When a diver uses two or more tanks 11, a propulsion unit 14 can be provided for each tank, a single propulsion unit 14 can be mounted at the center of the tanks (for example, when a diver uses two side-by-side tanks, housing 17 is configured such that unit 14 is mounted in between the tanks), or a housing 17 can be provided that is configured to be mounted on multiple tanks and that includes one or more propulsion units 14. Unit 14 preferably is (when tank 11 is secured on the back of a diver) positioned above the diver's spine or the center of the diver's back. Positioning unit 14 at a location laterally spaced apart from the center of the diver's back causes unit 14, when propeller 21 is operated, to generate forces that tend to turn a diver to one side. The generation of such forces is preferably avoided.

The negative buoyancy of unit 14 is presently typically about 4.8 pounds. An air bladder associated with tank 11 can, if desired, be inflated to offset such negative buoyancy.

Tank 11 (with unit 14 attached) is secured to the back of a diver using a conventional harness assembly (not shown) such that end 44 is adjacent the lower back of the diver and end 45 is adjacent the upper back of the diver. The diver holds grip 28 in one of his or her hands. When the diver is in the water, propeller 21 is activated by depressing and releasing button 29. Propeller 21 is turned off by again depressing and releasing button 29.

One advantage of the propulsion unit 14 is that battery module 15 is maintained separate from the motor-transmission module 16. This is preferred because the module 15 ordinarily generates hydrogen. Module 16 preferably includes a substance that absorbs hydrogen, and includes a pressure relief screw. Module 16 is changeable underwater.

Module 15 preferably includes a temperature sensor that, when a particular elevated temperature is detected by the sensor, turns off unit 14. When unit 14 is turned off, propeller 21 does not rotate, electricity is not being drawn from battery module 15, and the battery in module 15 cools down. The battery in module 15 preferably is a rechargeable battery.

If desired, means can be provided to install and remove pin 43 such that when the battery in module 15 is being charged, pin 43 is removed so there is no electrical connection between module 15 and connector 24. Once recharging is completed, the pin 43 is reinstalled to re-establish the electrical connection between module 15 and connector 24.

If desired, unit 14 can be constructed such that motor 60 and/or propeller 21 operates at two or more speeds. An appropriate control unit can be provided that enables a diver manually or otherwise to alter the speed at which propeller 21 turns.

Transmission 61 is an important component in unit 14 because it increases the torque derived from motor 60 and facilitates the production of the torque desired to turn propeller 21.

Propeller hub 52 is secured to shaft 49 with an aluminum shear pin (not shown) so that if blades 50 and 51 are caught and hub 52 will not rotate, the aluminum pin will shear to prevent damage to the motor 60 or transmission 61. Bundling motor 60, transmission 61, and propeller shaft 49 in a single module 16 facilitates the compact storage and use of unit 14 and also facilitates the ready assembly and disassembly of unit 14.

We claim:

1. A scuba diving propulsion system for a gas tank (11) worn by a diver, the propulsion system comprising (a) a bracket (17);

(b) apparatus (25) to secure removably said bracket to the tank (11);

(c) a battery module (15) removably mounted on and contacting said bracket;

(d) a motive power module (16) removably mounted on and contacting said bracket separately from said battery module, and including an electric motor, a transmission operatively associated with said motor to increase the torque produced by said motor, a propeller shaft operatively associated with said transmission, and a propeller mounted on said propeller shaft; and, (e) an electrical connector (24) on said bracket (17) to interconnect electrically said battery module (15) and said power module (16);

said bracket including (f) a first opening shaped and dimensioned to slidably receive said battery module when said battery module is mounted on said bracket; and, (g) a second opening spaced apart from said first opening and shaped and dimensioned to slidably receive said power module when said battery module is mounted on said bracket.

2. A propulsion unit for scuba diving breathing equipment, the breathing equipment including a tank of breathable gas and a regulator attached to the tank to supply breathable gas from the tank to a diver, said propulsion unit comprising (a) a bracket;

(b) apparatus to secure removably said bracket to said tank;

(c) a battery module detachably slidably mounted on and contacting said bracket;

(d) a motive power module operatively associated with said battery module, detachably slidably mounted on and contacting said bracket, spaced apart from said battery module, and including (i) an electric motor, (ii) a transmission operatively associated with said motor, (iii) a propeller shaft operatively associated with said transmission, and (iv) a propeller mounted on said propeller shaft: said bracket including (e) a first opening shaped and dimensioned to slidably receive said battery module when said battery module is mounted on said bracket; and, (f) a second opening spaced apart from said first opening and shaped and dimensioned to slidably receive said power module when said power module is mounted on said bracket.

3. A propulsion unit for scuba diving breathing equipment, the breathing equipment including a tank of breathable gas and a regulator attached to the tank to supply breathable gas from the tank to a diver, the tank having a longitudinal axis (Y), said propulsion unit comprising (a) a bracket;

(b) apparatus to secure removably said bracket to said tank;

(c) an electrical connector mounted on said bracket;

(d) a battery module detachably mounted on and contacting said bracket and electrically attached to said electrical connector;

(e) a motive power module detachably mounted on and contacting said bracket, spaced apart from said battery module, and including (i) an electric motor, (ii) a transmission operatively associated with said motor, (iii) a propeller shaft operatively associated with said transmission, and (iv) a propeller mounted on said propeller shaft, said power module electrically attached to said electrical connector such that electricity flows from said battery module through said electrical connector to said power module, and canted on said bracket with respect to the longitudinal axis (Y) of the tank to produce a force (F2) that presses downwardly against the back of a diver wearing the tank.

4. A propulsion unit for scuba diving breathing equipment the breathing equipment including a tank of breathable gas and a regulator attached to the tank to supply breathable gas from the tank to a diver, the tank having a longitudinal axis (Y), said propulsion unit comprising (a) a bracket;

(b) apparatus to secure removably said bracket to said tank;

(c) an electrical connector mounted on said bracket;

(d) a battery module detachably mounted on and contacting said bracket and electrically attached to said electrical connector;

(e) a motive power module detachably mounted on and contacting said bracket, spaced apart from said battery module, and including (i) an electric motor, (ii) a transmission operatively associated with said motor, (iii) a propeller shaft operatively associated with said transmission, and (iv) a propeller mounted on said propeller shaft, said power module electrically attached to said electrical connector such that electricity flows from said battery module through said electrical connector to said power module, and canted on said bracket with respect to the longitudinal axis (Y) of the tank to produce a force (F2) that presses downwardly against the back of a diver wearing the tank;

said bracket including (f) a first opening shaped and dimensioned to slidably receive said battery module when said battery module is mounted on said bracket; and, (g) a second opening spaced apart from said first opening and shaped and dimensioned to slidably receive said power module when said power module is mounted on said bracket.

5. A propulsion unit for scuba diving breathing equipment, the breathing equipment including a tank of breathable gas and a regulator attached to the tank to supply breathable gas from the tank to a diver, the tank having a longitudinal axis (Y), said propulsion unit comprising (a) a bracket;

(b) apparatus to secure removably said bracket to said tank;

(c) an electrical connector mounted on said bracket;

(d) a battery module detachably mounted on and contacting said bracket and electrically attached to said electrical connector;

(e) a motive power module detachably mounted on and contacting said bracket, spaced apart from said battery module, and including (i) an electric motor, (ii) a transmission operatively associated with said motor, (iii) a propeller shaft operative associated with said transmission, and (iv) a propeller mounted on said propeller shaft, said power module electrically attached to said electrical connector such that electricity flows from said battery module through said electrical connector to said power module, and canted on said bracket with respect to the longitudinal axis (Y) of the tank to produce a force (F2) that presses downwardly against the back of a diver wearing the tank;

said battery module and said power module each including an electrical connection member (43, 47) that interconnects electrically with said electrical connector.

6. A scuba diving propulsion system for a gas tank (11) worn by a diver, the propulsion system comprising (a) a bracket (17);

(b) apparatus (25) to secure removably said bracket to the tank (11);

(c) a battery module (15) removably mounted on and contacting said bracket;

(d) a motive power module (16) removably mounted on and contacting said bracket separately from said battery module, and including an electric motor, a transmission operatively associated with said motor to increase the torque produced by said motor, a propeller shaft operatively associated with said transmission, and a propeller mounted on said propeller shaft; and, (e) an electrical connector (24) on said bracket (17) to interconnect electrically said battery module (15) and said power module (16);

said electrical connector (24) mounted on said bracket (17) in fixed position intermediate sad battery module and said power module.

7. The propulsion system of claim 6 wherein said battery module and said power module each include an electrical connection pin (43, 47) that slidably interconnects electrically with said electrical connector in said bracket.

* * * * *